United States Patent [19]

Schwab

[11] 4,064,650

[45] Dec. 27, 1977

[54] DOOR LATCH

[75] Inventor: A. Henry Schwab, Fort Washington, Pa.

[73] Assignee: Philadelphia Tramrail Company, Philadelphia, Pa.

[21] Appl. No.: 683,150

[22] Filed: May 4, 1976

[51] Int. Cl.[2] ..... E05F 11/54; E05C 3/00

[52] U.S. Cl. ..... 49/277; 49/394; 292/210

[58] Field of Search ..... 292/210, 278; 49/394, 49/171, 276, 277, 278

[56] References Cited

U.S. PATENT DOCUMENTS

| | | | |
|---|---|---|---|
| 676,779 | 6/1901 | Stahl | 49/276 |
| 1,711,213 | 4/1929 | Smith | 49/394 |

*Primary Examiner*—Paul R. Gilliam
*Assistant Examiner*—Kenneth J. Dorner
*Attorney, Agent, or Firm*—Seidel, Gonda & Goldhammer

[57] ABSTRACT

A door latch arrangement is disclosed to prevent a door from popping open when the door is subjected to pressure from the inside. Means are provided to restrain movement of the door latch until the door and latch have moved partially open, thereafter the door is free to manipulated to a fully open position.

13 Claims, 3 Drawing Figures

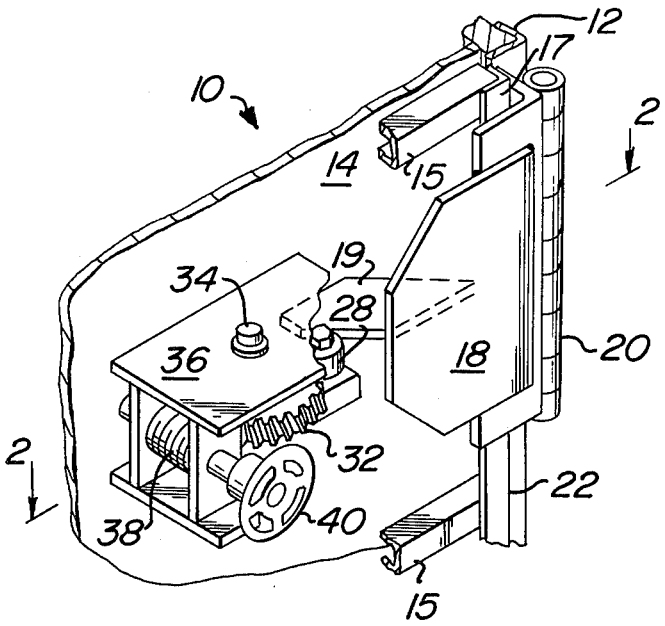
FIG. 1
FIG. 2
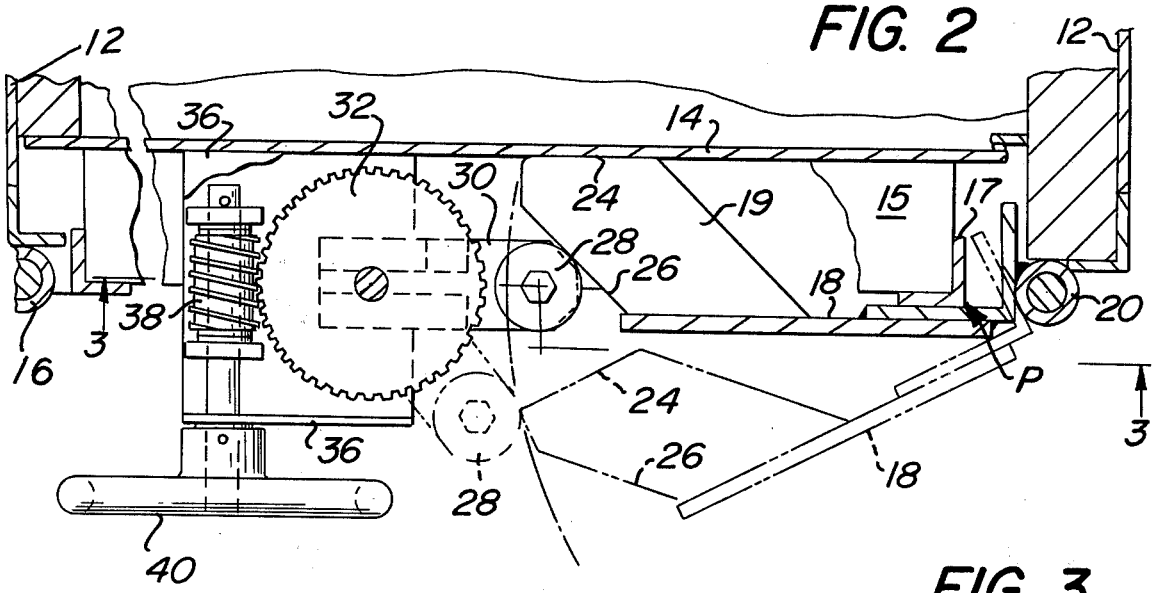
FIG. 3
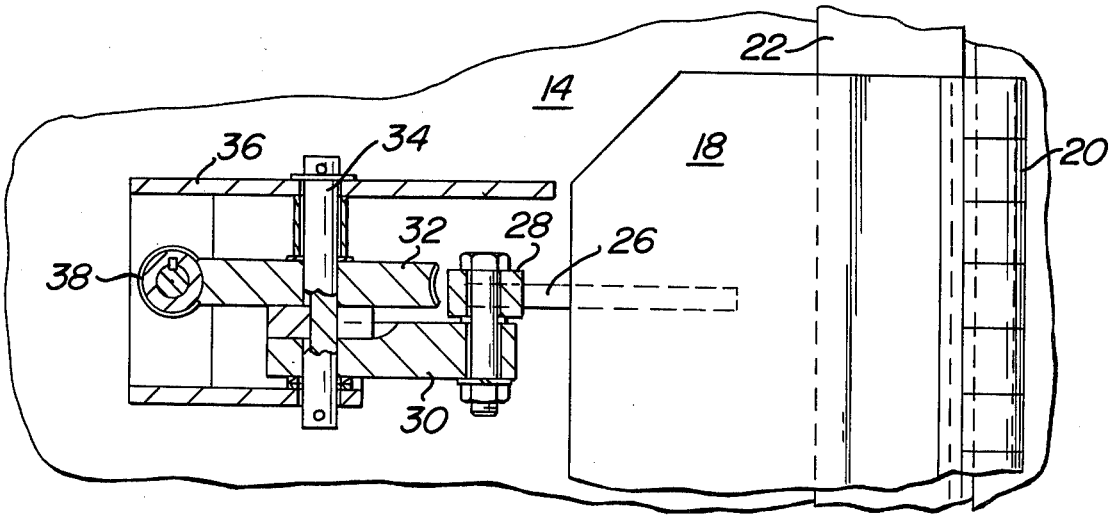

DOOR LATCH

SUMMARY OF THE INVENTION

The apparatus of the present invention includes the environment of a housing having an opening adapted to be closed by a door. The door is pivotably or otherwise movably supported by the housing for movement from a position wherein it closes the opening to a position wherein the opening is unobstructed.

A latch means is provided for controlling the initial opening movement of the door so that the door does not pop open. The latch means includes a latch movably supported by the housing and overlying a portion of the door to thereby obstruct movement of the door from its closed position to its open position. The latch has a cam surface which cooperates with a cam follower to block opening movement to the door. A mechanical means is connected to the cam follower for moving the cam follower away from the cam surface at a controlled rate until the cam follower no longer contacts the cam surface whereby the latch and the door are each freely movable to an open disposition.

The present invention is adaptable for use in connection with doors on a variety of different types of housings wherein the door while in its closed position is subjected to substantial internal pressure. Under such circumstances, when the door is unlatched, it pops open. For example, paper products are compressed by a platen within a baler. Access to the baling chamber is attained by way of a door. The internal pressure of the compressed paper products on the door is a safety hazard since it causes the door to pop open when the door is unlatched. The present invention is adaptable for use in environments wherein the the door is subjected to pressure by way of a product or by way of a gas.

It is an object of the present invention to provide a door latch which cooperates with a door to retain a door in a closed position and controls the initial opening movement of the door so as to prevent the door from popping open.

It is another object of the present invention to provide a door latch which is simple, reliable and inexpensive while being capable of preventing a door from popping open.

Other objects will appear hereinafter.

For the purpose of illustrating the invention, there is shown in the drawings a form which is presently preferred; it being understood, however, that this invention is not limited to the precise arrangements and instrumentalities shown.

FIG. 1 is a partial perspective view of a housing incorporating the present invention.

FIG. 2 is a sectional view taken along the line 2—2 in FIG. 1 but on an enlarged scale.

FIG. 3 is a sectional view taken along the line 3—3 in FIG. 2.

Referring to the drawing in detail, wherein like numerals indicate like elements, there is shown in FIG. 1 an apparatus in accordance with the present invention designated generally as 10.

As shown in the drawing, the apparatus 10 includes a housing 12 which may be any housing having a door 14 which is subjected to pressure from within the housing. In a preferred embodiment of the present invention, the housing 12 is part of a baler for compressing paper, paperboard and other waste products into a bale. When such products are compressed into a bale, there is substantial pressure on the inner surface of the door 14 tending to cause the door to move to an open disposition. When door 14 is open, the opening in the housing 12 is unobstructed to facilitate removal of the bale.

The door 14 is supported by the housing 12 for movement between open and closed dispositions in any convenient manner. As illustrated, door 14 is connected to the housing 12 by a hinge 16 for pivotable movement between the closed disposition shown in the drawing and an open disposition. The door 14 moves clockwise in FIG. 2 from the closed disposition shown to an open disposition. Reinforcement channels 15 are welded or otherwise fixedly secured to door 14. Angle iron members 17 interconnect the ends of channels 15.

As illustrated, movement of the door 14 toward an open disposition is blocked by a latch 18. The latch 18 is movably supported by the housing 12 in any convenient manner. The preferred construction involves pivoting the latch 18 to an upright pillar 22 on the housing 12 so that the latch 18 pivots about the hinge 20 from the solid line position shown in FIG. 2 to the phantom position shown in FIG. 2.

The latch 18 includes a plate 19 extending toward the outer surface of the door 14. The plate 19 has a door contacting surface 24 and a cam surface 26. The surfaces 24 and 26 converge so as to form an acute angle of approximately 45°. The cam surface 26 is of substantial length so as to control the initial 5°–20° of opening movement of the door 14. As illustrated in FIG. 2, the surface 26 is of sufficient length so as to control the initial 25° of opening movement of the door 14. In an actual embodiment of the present invention, surface 26 has a length of approximately 4½ inches.

Surface 24 in the plate 19 is maintained in contact with the outer surface of the door 14 due to the relationship between cam surface 26 and a cam follower 28. Cam follower 28 prevents the latch 18 from pivoting to the phantom position in FIG. 2 until such pivoting movement is desired. When it is desired to open the door 14, the cam follower 28 cooperates with cam surface 26 to permit opening movement of the door 14 in a controlled manner so that door 14 pivots through a substantial arc sufficient to release its internal bias forces and thereby is no longer subject to popping open.

The cam follower 28 is rotatably supported at one end of arm 30. See FIGS. 2 and 3. The other end of arm 30 is keyed or otherwise fastened to a pin 34. A gear 32 is secured to the pin 34 and rotates therewith. If desired, arm 30 may be fixedly secured directly to gear 32 for rotation therewith relative to the pin 34. The important relationship is that the arm 30 rotates with the gear 32.

Gear 32 is driven by a worm 38. Worm 38 is on a shaft supported by a bracket 36. Bracket 36 is fixedly secured to the outer surface of the door 14 and moves therewith. The shaft for worm 38 is provided with a hand wheel 40. Door 14 may be provided with a handle which may assume a wide variety of configurations.

The apparatus 10 of the present invention operates as follows:

It is assumed that the housing 12 is pressurized or contains material under pressure which exerts a biasing force on the door 14 tending to move the door 14 to an open disposition. If the door 14 is unlatched under these circumstances, it tends to pop open until the pressure forces thereon are relieved. The apparatus of the present invention prevents such popping open of the door 14.

The pressure on door 14 is transmitted by member 17 to latch 18 at point P close to the hinge 20. Plate 19 contacts door 14 at a location spaced from hinge 20 so as to provide a large mechanical advantage. Hand wheel 40 is rotated in the appropriate direction so as to rotate gear 32 and arm 30. Such rotation of the hand wheel 40 causes the arm 30 to rotate from the solid line position in FIG. 2 to the phantom position in FIG. 2. During such movement of the arm 30, the follower 28 remains in contact with the cam surface 26 until the cam follower 28 has been moved to the phantom position in FIG. 2 whereby it clears the plate 19. At this point, the door 14 has been progressively moving from its closed position towards its open position at the rate corresponding to the rotation of arm 30.

When the latch 18 and cam follower 28 are in the phantom position shown in FIG. 2, the door 14 has moved through a substantial arc so as to sufficiently relieve the internal bias forces thereon. At this point, the latch 18 is manually manipulated out of the path of movement of door 14 such as by rotating the latch 18 in a counterclockwise direction as seen in FIG. 2. Thereafter, hand wheel 40 is used as a handle to move the door 14 to its fully open disposition. Elements 28–40 constitute a latch retainer and move with the door 14 since they are supported thereby.

In addition to the mechanical advantage discussed above, there is a second mechanical advantage in latch retainer, namely the number of turns of wheel 40 versus the movement of cam follower 28. The latch retainer provides a non-reversing locking advantage. While wheel 40 and worm 38 can move gear 32, the reverse is not true. Due to the helix angle of the worm 38 and gear 32, turning movement forces on gear 32 will not turn worm 38. The combination of the mechanical advantages set forth above and the non-reversible drive for gear 32 enables the latch 10 to resist large pressure force on door 14.

The components of the latch and latch retainer are easily fabricated from any desired metal and/or are commercially available components which may be purchased on the open market. Hence, no special tooling is required for constructing the latch 18 and its retainer.

It is within the scope of this invention to reverse the position of the latch 18 and the latch retainer. That is, latch 18 may be pivotably supported by door 14 and elements 28–40 may be supported on the housing 12 for cooperation with latch 18 in the same manner as described above.

The present invention may be embodied in other specific forms without departing from the spirit or essential attributes thereof and, accordingly, reference should be made to the appended claims, rather than to the foregoing specification as indicating the scope of the invention.

I claim:

1. An apparatus comprising a housing having an opening, a door movably supported by said housing for movement from a position wherein it closes said opening to a position wherein the opening is unobstructed, latch means for controlling the initial opening movement of said door so that the door does not pop open, said latch means including a latch movably supported by the housing and overlying a portion of the door and a cam follower movably supported by the door, said latch having a cam surface cooperating with said cam follower to block opening movement of the door, means connected to the cam follower and selectively operable for moving the cam follower along the cam surface and in a direction away from the door until the cam follower is out of the path of movement of the cam surface on said latch whereby the latch and door are thereafter movable to an open disposition.

2. Apparatus in accordance with claim 1 wherein said door is pivotably connected to said housing along a side edge thereof, said latch means being pivotably connected to said housing adjacent an edge of said door opposite to said first mentioned edge of said door.

3. Apparatus in accordance with claim 1 wherein said means connected to the cam follower for moving the cam follower includes an arm supporting said cam follower and a rotatably supported gear, said cam follower being connected to said rotatably supported gear for rotation therewith.

4. Apparatus in accordance with claim 3 wherein said gear and cam follower as well as said arm are supported by the outer surface of said door for movement with said door.

5. Apparatus in accordance with claim 1 wherein said door is pivotably supported by said housing, said cam surface having a length sufficient so as to remain in contact with the cam follower until the door has pivoted from a closed disposition toward an open disposition through an arc of 5° to 20° before the cam follower loses contact with the cam surface.

6. Apparatus comprising a housing having an opening, a door pivotably supported by the housing for closing said opening and for moving to an open disposition wherein the said opening is unobstructed, latch means for controlling the initial opening movement of said door so that the door does not pop open, said latch means including a latch pivotably supported by the housing and overlying a portion of the door and in contact with the door so that internal biasing forces on the door are transmitted to the latch, said latch means including a latch retainer for controllably restraining the pivotable movement of the latch in a direction away from the door until the door has pivoted toward an open disposition through an arc of at least 5° and not more than about 25°, and said latch being out of contact with said latch retainer after said door has pivoted through said arc whereby the latch and door are freely pivotable to open dispositions.

7. Apparatus in accordance with claim 6 wherein said latch retainer is supported by said door, said latch retainer including a cam follower and a handle coupled thereto for rotating the cam follower through said arc, and a cam surface on said latch in contact with said cam follower.

8. Apparatus in accordance with claim 6 wherein said door pivots outwardly from said housing, said latch is pivotably supported on the outer face of said housing and said latch retainer is pivotably supported on the outer face of said door.

9. Apparatus in accordance with claim 8 wherein said latch contacts the outer face of said door at a location between said housing and said latch retainer.

10. Apparatus comprising a housing having an opening, a door pivotably supported by said housing for movement between a closed position and an open position with respect to said opening, latch means for controlling the initial opening movement of said door so that said door does not pop open, said latch means including a latch pivotably supported by one of said housing and door, said latch means including a latch retainer supported by the other of said housing and door, said latch retainer including a movable cam follower, said latch retainer cooperating with said latch to restrain movement of the latch in a direction corresponding to the direction of movement of the door toward its open position, said latch having a cam surface in contact with said cam follower, said cam surface being at an acute angle with respect to the plane of the outer surface of said door, and said latch retainer including means connected to the cam follower for selectively moving the cam follower along said cam surface and in a direction away from the door while the door moves toward an open position for a sufficient distance to relief internal pressure on it and then cause the cam follower to lose contact with said cam surface whereby said latch and door are then freely movable to an open disposition.

11. Apparatus in accordance with claim 10 wherein said latch is pivotably supported by said housing and said latch retainer is supported by said door for movement with said door.

12. Apparatus in accordance with claim 10 wherein said cam follower is connected to an arm, a gear rotatable with said arm, a worm connected to said gear for driving said gear, and a handle connected to said worm for rotating said worm about an axis perpendicular to said door.

13. Apparatus comprising a housing having an opening, a door pivotably supported by said housing along one side of said opening for movement between a closed position and an open position with respect to said opening, latch means for controlling the initial opening movement to said door so that said door does not pop open, said latch means including a latch pivotably supported by said housing along an opposite side of said opening, said latch means including a latch retainer supported by said door, said latch retainer including a cam follower, said latch retainer cooperating with said latch to restrain movement of the latch in a direction corresponding to the direction of movement of the door toward its open position, said latch having a cam surface in contact with said cam follower, said cam surface being at an acute angle with respect to the plane of the outer surface of said door, said door contacting said latch at a location between said cam surface and the pivotal axis of said latch, and said latch retainer including an arm connected to the cam follower for selectively moving the cam follower along said cam surface and in a direction away from the door while the door moves toward an open position for a sufficient distance to relieve internal pressure on it and then causes the cam follower to lose contact with said cam surface whereby said latch and door are then freely movable in opposite directions to an open disposition, said latch retainer including a gear rotatable with said arm, a worm connected to said gear for driving said gear and a handle connected to said worm for rotating said worm about an axis perpendicular to said door.

* * * * *